United States Patent [19]

Bayliss

[11] 4,420,065

[45] Dec. 13, 1983

[54] RAILWAY BRAKES

[75] Inventor: John P. Bayliss, Redditch, England

[73] Assignee: Lucas Industries Limited, Birmingham, England

[21] Appl. No.: 179,534

[22] Filed: Aug. 19, 1980

[30] Foreign Application Priority Data

Sep. 7, 1979 [GB] United Kingdom ..... 7931225

[51] Int. Cl.[3] ..... B61H 13/38

[52] U.S. Cl. ..... 188/56; 188/74; 188/206 R

[58] Field of Search ..... 188/49, 50, 51, 52, 188/53, 54, 55, 56, 206 R, 212, 213, 74, 365, 153 R

[56] References Cited

U.S. PATENT DOCUMENTS

| | | | |
|---|---|---|---|
| 96,375 | 11/1869 | Cowan | 188/53 |
| 147,407 | 2/1874 | Kirchrath | 188/52 |
| 1,466,452 | 8/1923 | Lipcot et al. | 188/56 X |
| 1,796,605 | 3/1931 | Leggemann et al. | 188/212 |
| 2,215,351 | 9/1940 | Farmer | 188/56 X |
| 2,561,454 | 7/1951 | Williams | 188/53 |
| 2,889,785 | 6/1959 | Browne | 105/215 |
| 2,969,129 | 1/1961 | Browne et al. | 188/212 X |
| 3,160,234 | 12/1964 | Polanin | 188/53 |
| 4,056,171 | 11/1977 | Tickle | 188/74 X |

FOREIGN PATENT DOCUMENTS

| | | | |
|---|---|---|---|
| 25290 | 3/1981 | European Pat. Off. | 188/49 |
| 1948751 | 8/1966 | Fed. Rep. of Germany . | |
| 2719197 | 11/1978 | Fed. Rep. of Germany | 188/56 |
| 739404 | 1/1933 | France | 188/153 R |
| 440131 | 12/1935 | United Kingdom | 188/206 R |

*Primary Examiner*—George E. A. Halvosa
*Attorney, Agent, or Firm*—Scrivener, Clarke, Scrivener and Johnson

[57] ABSTRACT

A tread brake for braking a wheel (2) of a railway vehicle which is sprung relative to a frame (4) of the vehicle, comprises an actuator (5) suspended from the frame (4) by a swing arm (6), and a rigid link arm (7) fixed to the actuator (5) and connected through a pivot (8) parallel to the wheel axis to a bracket (9) fixedly mounted to a bearing in which the wheel axle is journalled. The link arm (7) adjusts the position of the actuator (5) in response to any movement of the wheel (2) relative to the frame (4) so that the braking element (11) is always applied substantially radially to the wheel, which allows the element to take the form of an elongate rod of friction material. A new handbrake structure is also described.

4 Claims, 4 Drawing Figures

RAILWAY BRAKES

This invention relates to brakes for railway vehicles and in particular to such brakes of the kind which are arranged to act against the periphery of the vehicle wheel and are commonly referred to as tread brakes.

Hitherto tread brakes have consisted of an actuator fixedly mounted on the bogie frame of the railway car, and an arcuate brake element or shoe shaped to conform to the periphery of the wheel to be braked and arranged to be applied against the wheel rim, generally radially to the wheel, by the actuator. The vehicle wheels are, of course, sprung with respect to the bogie frame and in order to cater for the movements of the wheel relative to the tread brake actuator due to the vehicle suspension, the brake shoes have in the past been adapted to pivot about an axis parallel to the wheel axis so that they are applied uniformly to the wheel whenever the brakes are operated. These known brakes operate satisfactorily. However, the linings of friction material in the known tread brakes need to be replaced quite frequently due to wear. Because the shoes have a large area and contact the wheel over a considerable extent of the wheel periphery, it is not possible to avoid frequent replacement of the linings by making the linings thicker.

The present invention aims at a solution to the above problem and resides in a railway vehicle tread brake which is characterised in that the actuator is movably mounted to the frame, and the actuator is coupled to a member fixed with respect to the wheel axis for the actuator to be moved in response to displacement of the wheel axis relative to the frame so that the actuator is operable to apply the braking element against the wheel substantially radially to the wheel axis whatever the position of the wheel axis relative to the frame.

By mounting the actuator on the frame so that it moves with the wheel, a pivoted, arcuate brake shoe is no longer required. Instead it is possible to use an elongate rod of friction material which is urged longitudinally against the wheel. The cross-section of the rod may be comparatively small so that the problems of localised hot spots do not arise. The rod of frictional material may be of considerable length with a comparatively small cross-section and therefore need to be replaced much less frequently than the linings of the conventional tread brakes.

The actuator may be suspended from the frame by a pivot arm and be coupled to the housing of a bearing in which the wheel axle is journalled, by a rigid arm connected to the bearing housing through a pivot. Due to their suspension, railway wheels are known to move longitudinally and vertically and with this construction it is ensured that the actuator follows these movements.

A more complete understanding of the invention will be had from the following detailed description which is given by way of example with reference to the accompanying drawings, in which:-

Figure 1:
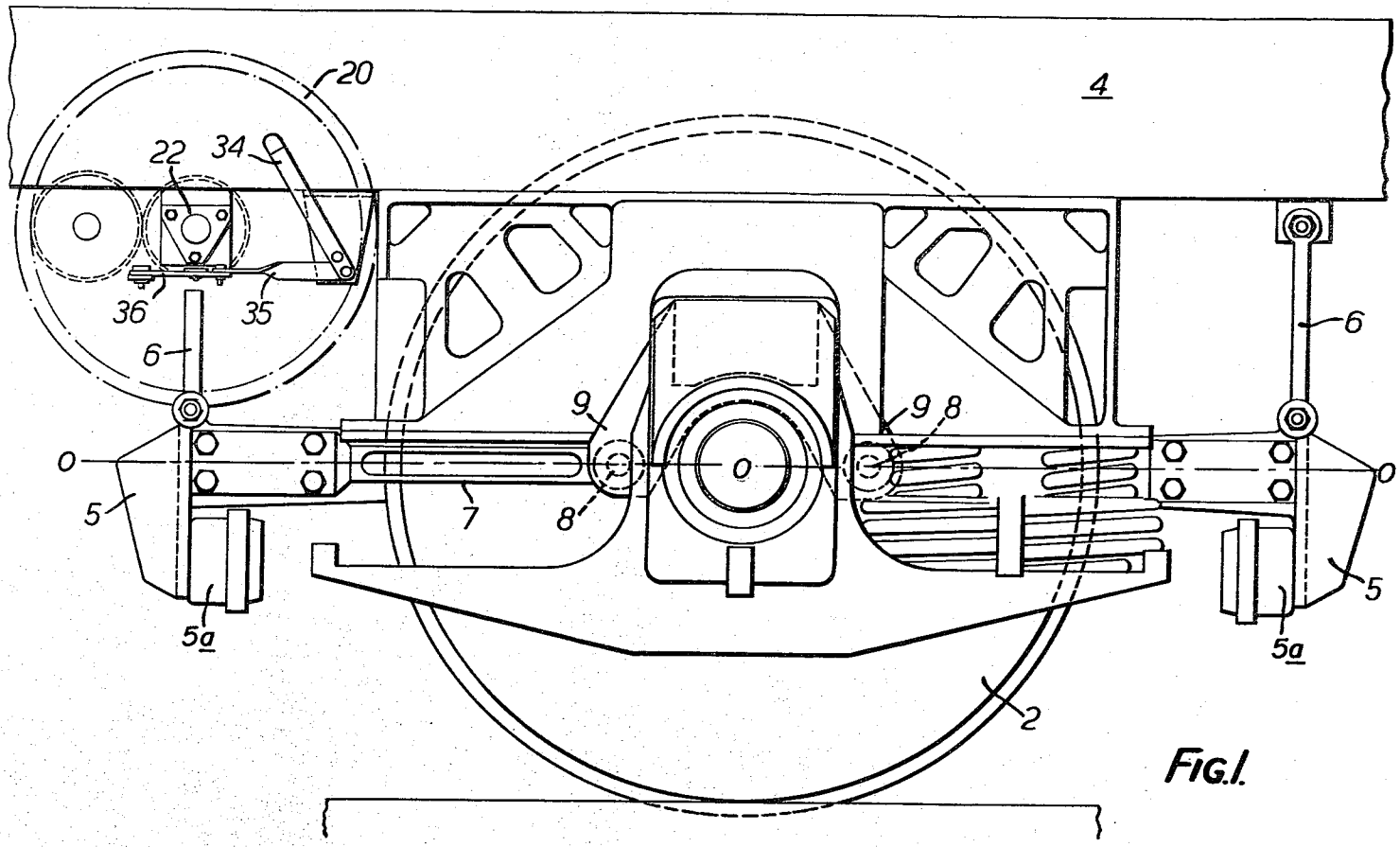
FIG. 1 is a side elevation of a railway brake assembly embodying the invention.
Figure 2:
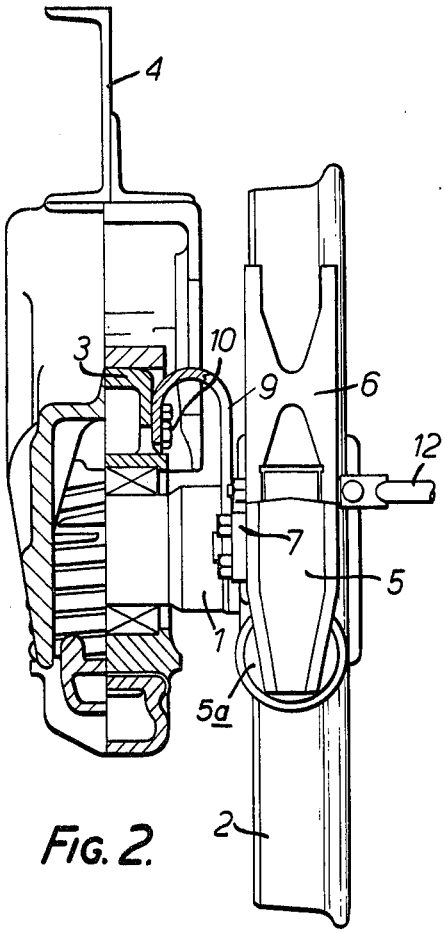
FIG. 2 is an end view of the assembly shown partly in cross-section.
Figure 4:
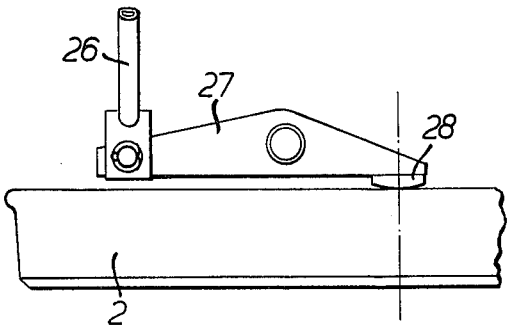
FIG. 4 is an end view showing a detail of a hand operated brake included in the assembly.
Figure 3:
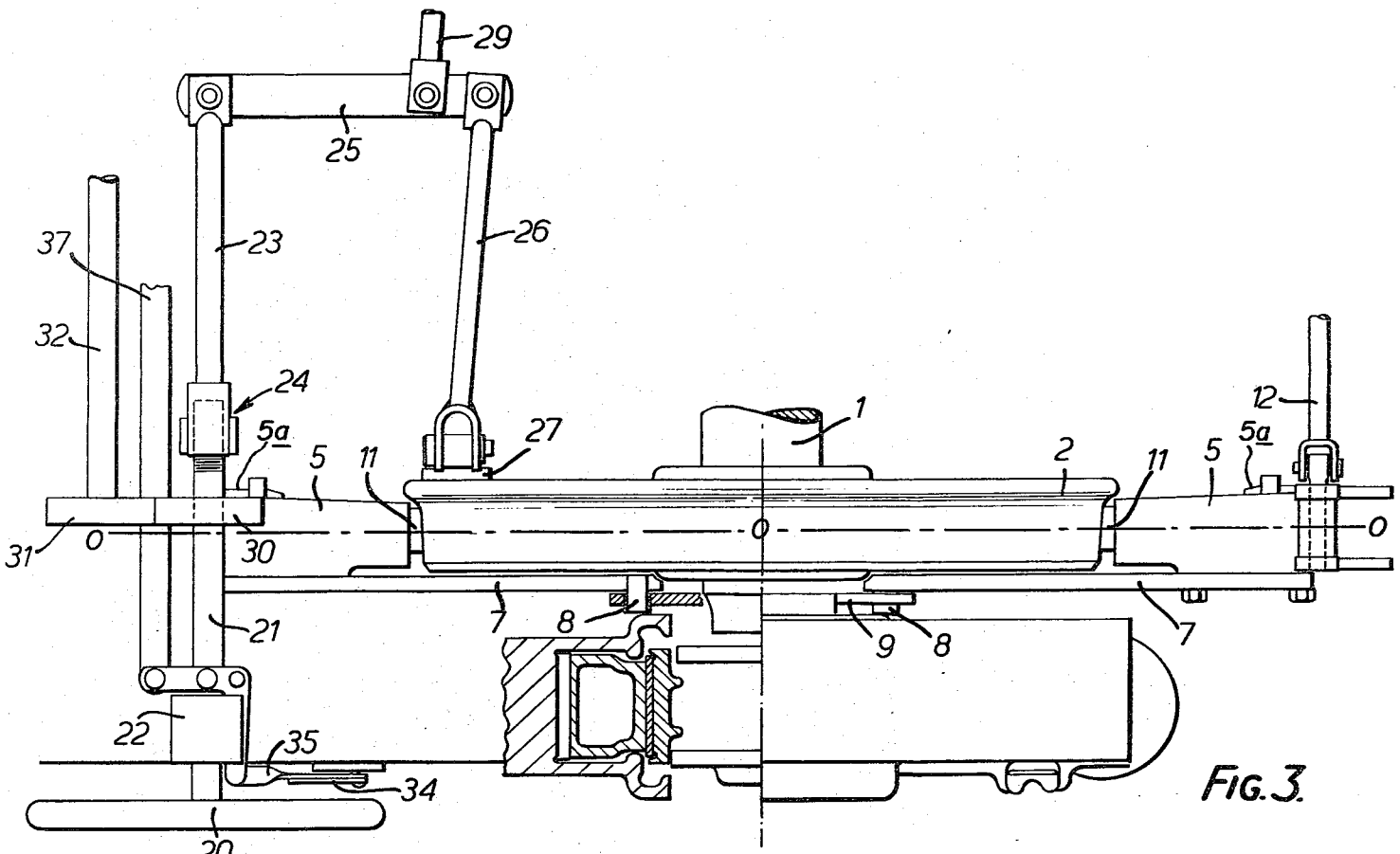
FIG. 3 is a top plan view of the brake assembly.

Referring to the drawings, the axle 1 of a wheel 2 is journalled in a bearing having a housing 3 which is sprung with respect to the bogie frame 4 of the railway car. The wheel 2 has a pair of opposed tread brakes each including a power actuator 5 suspended from the frame 4 by a swing arm 6 pivoted at its opposite ends to the frame 4 and to the actuator housing for movement about axes parallel to the wheel axis. Each actuator 5 includes the fluid pressure motor **5*a* shown, and a rigid link arm 7 is firmly attached to each actuator housing and extends forwardly from the actuator, generally radially of the wheel, to an end which is pivoted by a pin 8 to one ear of a yoke-shaped bracket 9. At its upper end, the bracket turns over and is securely fixed to the bearing housing 3 by bolts 10. The axes of the pivot pins 8 are parallel to the wheel axis and diametrically opposite each other with respect to the wheel axis. Furthermore, the positions of the axes of pins 8 are fixed with respect to the wheel axis since the bracket 9 is secured to the bearing housing 3** and, therefore, moves up and down, and backwards and forwards, with the wheel as the latter moves due to the railway car suspension.

Upon energization of the motors **5*a*, the actuators 5 are adapted to press elongate rods 11 of friction material against the periphery of the wheel rim when the brakes are applied, the line of action 0—0 of the actuators being parallel to the link arms 7 and through the axes of the pivotal connections between the link arms 7 and the bracket 9. Because the line of action 0—0 is spaced laterally from the link arms 7, there is a tendency for the arms 7 to bend away from the wheel 1 when the brakes are applied. To prevent the link arms 7 bending, the actuators 5 are coupled to the actuators of the brakes on the opposite side of the railway car by tie rods 12** which are pivoted to the actuator housings for movement about axes normal to the wheel axis.

From the foregoing it will be understood that if the wheel 2 is displaced vertically with respect to the frame 4, for example due to the car being loaded or unloaded, the bracket 9 moves with the wheel 2 and the link arms 7 cause the actuators 5 to move on their swing arm supports 6 so that the line of action 0—0 of the actuators on the rods is always substantially radial to the wheel; that is to say, in the plane of the wheel. As a result of this arrangement the rods 11 of friction material may have small effective areas compared with the conventional tread brake shoes but still brake the wheel efficiently. The rods 11 may be long without introducing any danger of localised hot spots during braking, so that the interval between operations to renew friction material can be increased as compared with conventional tread brakes.

While running along a rail, the wheel 2 can undergo longitudinal and vertical movements. In the described brake assembly the link arms 7 ensure that the actuators 5 move with the wheel in the horizontal and vertical planes so that brake operation is not influenced by the wheel movement in this direction.

The illustrated railway brake assembly also includes a novel handbrake structure. An operating wheel 20 is fast on a shaft 21 journalled in a bearing 22 supported by the frame 4. The shaft 21 is connected to the outer end of a pull rod 23 by a screw threaded coupling 24, the inner end of rod 23 being pivoted to one end of a link rod 25. A second pull rod 26 has its first end pivoted to the other end of the link rod 25 and its opposite end connected pivotally to one end of a brake lever 27 which is pivoted to a fixed structure intermediate its ends and carries a pad of friction material 28 at its other end. The lever 27 is mounted adjacent the wheel 2 for applying the pad 28 to the inside surface of the wheel rim when the hand brake is operated. A further pull rod 29 is connected pivotally to the link rod 25 and is coupled to a second lever 27 mounted adjacent the wheel on the other side of the railway car.

The shaft 21 carries a gear 30 which meshes with a gear 31 carried on the shaft 32 of a second operating wheel (not shown) provided on the other side of the vehicle to wheel 20 to allow the hand brake to be operated from either side.

When either of the operating wheels is turned to apply the hand brake, the pull rod 23 is moved towards wheel 20 due to the threaded coupling 24, and causes the rod 25 to rotate and move the rods 26, 29 inwardly, which in turn pivots the levers 27 and apply the pads of friction material 28 to the wheels. To provide an indication that the brake has been applied with the correct force an indicator is provided. It consists of a pivotally mounted indicator arm 34 coupled by a link arm 35 to one limb of a bell crank lever 36 which is pivotally mounted and has its other limb pivoted to the shaft 21. The shaft 21 is urged outwardly by a belleville spring (not shown). As the hand brake is applied with greater force, the tension in the rod 23, and hence the shaft 21, increases. The spring compresses and the shaft 21 moves inwardly causing the bell crank 36 and the indicator arm 34 to turn about their pivots. When the brake is properly applied the arm 34 occupies the 'on' position. Of course, when the brakes are released the spring expands and the indicator moves back automatically to the 'off' position. To allow the hand brake condition to be determined from either side of the vehicle a second indicator is mounted on the side of the vehicle and is coupled to the bell crank lever 36 by a link arm 37.

What is claimed is:

1. A tread brake for a railway vehicle including a frame and a wheel having an axis and mounted on the frame by a spring suspension, the brake comprising a braking element comprising an elongate rod of friction material, a power actuator carrying said braking element and operable to drive the rod longitudinally in a substantially radial direction relative to the wheel for applying an end face of said rod against the periphery of the wheel to brake rotation of the wheel, an arm mounting the actuator to said frame for movement relative thereto, said arm being connected to the actuator and directly to the frame by respective pivots both substantially parallel to the wheel axis, a member fixed with respect to the wheel axis, and a rigid link coupling the actuator to said member, said rigid link being immovably fixed to the actuator and being connected to said member by a pivot having an axis substantially parallel to the wheel axis, said rigid link being arranged to move the actuator in response to displacement of the wheel axis relative to the frame so that the actuator applies said end face of the rod against the wheel substantially radially of the wheel axis whatever the position of the wheel axis relative to the frame, said rigid link and said arm mounting said actuator and said rod on the same side of the wheel axis and in the same plane as the wheel.

2. A tread brake according to claim 1, wherein said wheel is mounted on an axle, the axle is journalled in a bearing, and said member fixed with respect to the wheel axis comprises a bracket rigidly attached to said bearing.

3. A tread brake according to claim 1, wherein the wheel is mounted on an axle at one side of the vehicle, another wheel is mounted on said axle at the other side of the vehicle and has a respective brake associated therewith, and said actuator is coupled to the actuator of said brake at the other side of the vehicle by a rigid strut for transmitting lateral reaction forces therebetween.

4. A tread brake according to claim 3, wherein said strut is connected to each said actuator by a pivot having an axis substantially perpendicular to the wheel axis.

* * * * *